US009753429B2

(12) United States Patent
Yashiro et al.

(10) Patent No.: US 9,753,429 B2
(45) Date of Patent: Sep. 5, 2017

(54) IMAGE HEATING APPARATUS

(71) Applicant: CANON KABUSHIKI KAISHA, Tokyo (JP)

(72) Inventors: Ryo Yashiro, Tokyo (JP); Hidekazu Maruta, Abiko (JP); Masayuki Tamaki, Abiko (JP); Ryo Suzuki, Kashiwa (JP); Mitsuru Hasegawa, Tsukubamirai (JP); Rikiya Takemasa, Kashiwa (JP); Koichi Kakubari, Toride (JP); Shigeru Hirano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/935,248

(22) Filed: Nov. 6, 2015

(65) Prior Publication Data

US 2016/0132009 A1 May 12, 2016

(30) Foreign Application Priority Data

Nov. 11, 2014 (JP) ..... 2014-229324

(51) Int. Cl.
*G03G 15/20* (2006.01)
*G03G 21/16* (2006.01)

(52) U.S. Cl.
CPC ..... *G03G 21/1685* (2013.01); *G03G 15/2053* (2013.01); *G03G 21/1647* (2013.01); *G03G 2215/0129* (2013.01); *G03G 2215/2035* (2013.01)

(58) Field of Classification Search
CPC ..... G03G 2215/2016
See application file for complete search history.

(56) References Cited

U.S. PATENT DOCUMENTS 6,993,277 B2 * 1/2006 Nagasaki ..... G03G 15/2053 399/320
7,330,200 B2 * 2/2008 Vanous ..... G03D 13/002 347/140
9,471,018 B2 * 10/2016 Kawaguchi ..... G03G 15/2053

FOREIGN PATENT DOCUMENTS

JP 2008286899 A * 11/2008
JP 2010066668 A * 3/2010
JP 2013101239 A 5/2013
JP 2013114130 A * 6/2013
JP 2014206672 A 10/2014
JP 2014232302 A 12/2014

* cited by examiner

*Primary Examiner* — Clayton E Laballe
*Assistant Examiner* — Leon W Rhodes, Jr.
(74) *Attorney, Agent, or Firm* — Canon U.S.A. Inc., IP Division

(57) ABSTRACT

A fixing apparatus including a flexible belt having a heat generating layer, an outer ring provided on one edge side of the belt and along an outer peripheral surface of the belt, the outer ring being electrically connected to the heat generating layer, an inner ring provided on the one edge side of the belt and along an inner peripheral surface of the belt to face the outer ring through the belt, and a power supply unit that is electrically connected to the outer ring and that feeds power. A difference obtained by subtracting a diameter of the inner ring at a normal temperature from a diameter of the inner ring at a fixing temperature is equivalent to or larger than a difference obtained by subtracting a diameter of the outer ring at the normal temperature from a diameter of the outer ring at the fixing temperature.

4 Claims, 9 Drawing Sheets

IMAGE HEATING APPARATUS

BACKGROUND OF THE INVENTION

Field of the Invention

The present disclosure relates to an image heating apparatus that heats and image on a sheet. The image heating apparatus is used in image forming apparatuses such as, for example, a copier, a printer, a fax machine, and a multifunctional apparatus provided with a plurality of the above functions.

Description of the Related Art

Hitherto, in image forming apparatuses such as an electrophotographic apparatus and an electrostatic recording apparatus, a toner image (a developer image) is formed on a sheet and is heated and compressed with a fixing apparatus serving as an image heating apparatus to fix the image on the sheet. In recent years, from the viewpoint of energy saving, a fixing apparatus of a type that uses a heat generating belt including a resistance layer has been proposed as a fixing apparatus with quick temperature rise (Japanese Patent Laid-Open No. 2014-232302). In the fixing apparatus of the above type, since the heat generating belt itself generates heat upon energization of the resistance layer, the heat of the belt can be efficiently transmitted to the sheet.

Furthermore, in the fixing apparatus described in Japanese Patent Laid-Open No. 2014-232302, a ring-shaped member is attached to an outer peripheral surface of the belt and power is fed to the resistance layer of the belt through the ring-shaped member. Such a configuration is capable of increasing the life of the belt.

However, such ring-shaped member goes through thermal expansion when heated upon execution of the fixing process and, accordingly, the adhesion with the belt decreases. Decrease in adhesion creates an unstable electrical connection between the ring-shaped member and brings about an occurrence of power feed failure.

SUMMARY OF THE INVENTION

An object of the present disclosure is to provide an image heating apparatus that suppresses occurrence of power feed failure.

Another object of the present disclosure is to provide an image heating apparatus, including a belt including a heat generating layer that generates heat, the belt being an endless and flexible belt that heats an image on a sheet; a drive unit that rotationally drives the belt; a first ring-shaped member that is provided on one edge side of the belt in a longitudinal direction of the belt and along an outer peripheral surface of the belt, the first ring-shaped member being electrically connected to the heat generating layer; a second ring-shaped member that is provided on the one edge side in the longitudinal direction and along an inner peripheral surface of the belt so as to face the first ring-shaped member through the belt; and a power feed unit that is electrically connected to the first ring-shaped member and that feeds power to the first ring-shaped member. In the image heating apparatus, a difference obtained by subtracting a diameter of the second ring-shaped member at a predetermined temperature from a diameter of the second ring-shaped member at a further higher temperature that is higher than the predetermined temperature is equivalent to or larger than a difference obtained by subtracting a diameter of the first ring-shaped member at the predetermined temperature from a diameter of the first ring-shaped member at the further higher temperature.

Further features of the present invention will become apparent from the following description of exemplary embodiments with reference to the attached drawings.

DESCRIPTION OF THE EMBODIMENTS

Hereinafter, modes for implementing the present disclosure will be described in detail while illustrating the exemplary embodiments. Note that in the following exemplary embodiments, description of an image forming apparatus will be given with a laser beam printer that employs an electrophotographic process as an example. In the description hereinafter, the laser beam printer will be referred to as a printer 1.

Exemplary Embodiment (Image Forming Unit)

Figure 1:
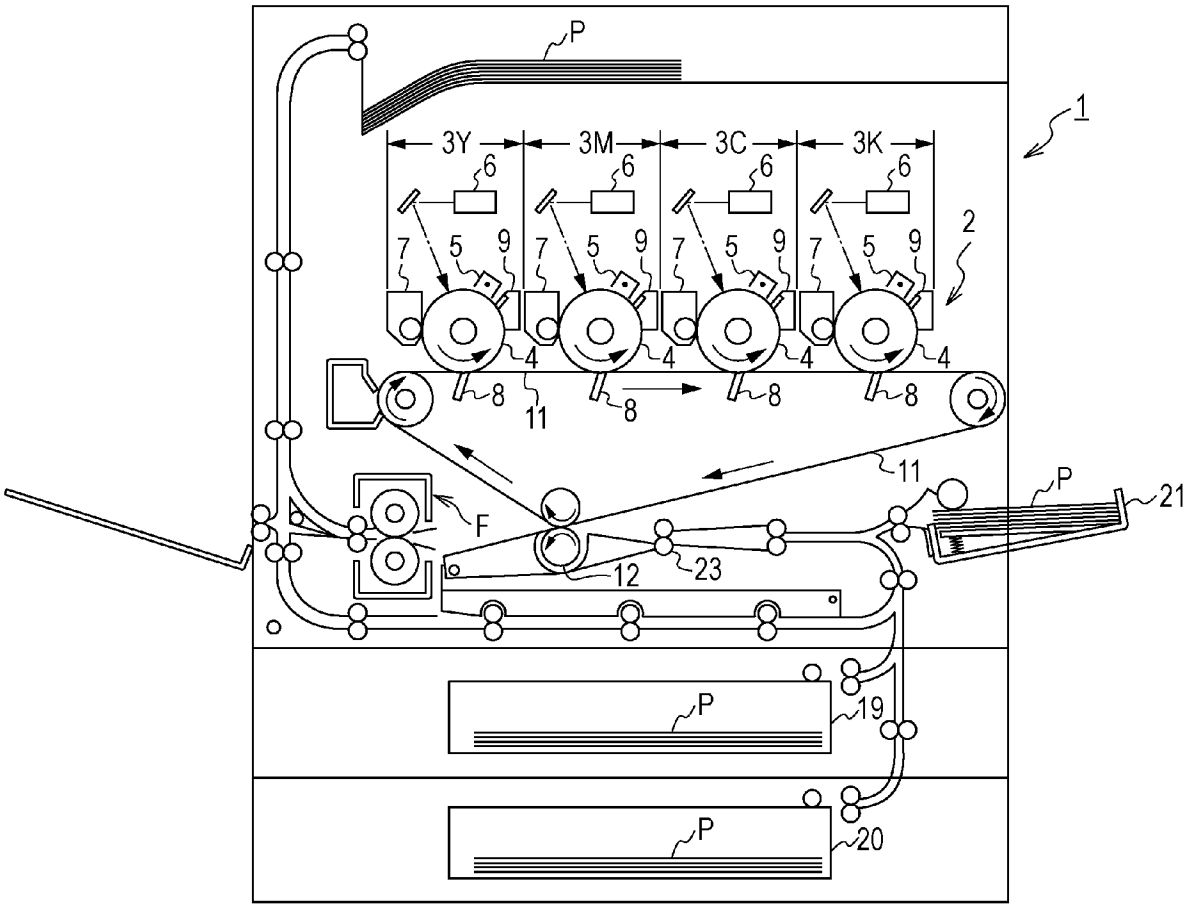
FIG. 1 is a block diagram of an image forming apparatus according to an exemplary embodiment.
Figure 2:
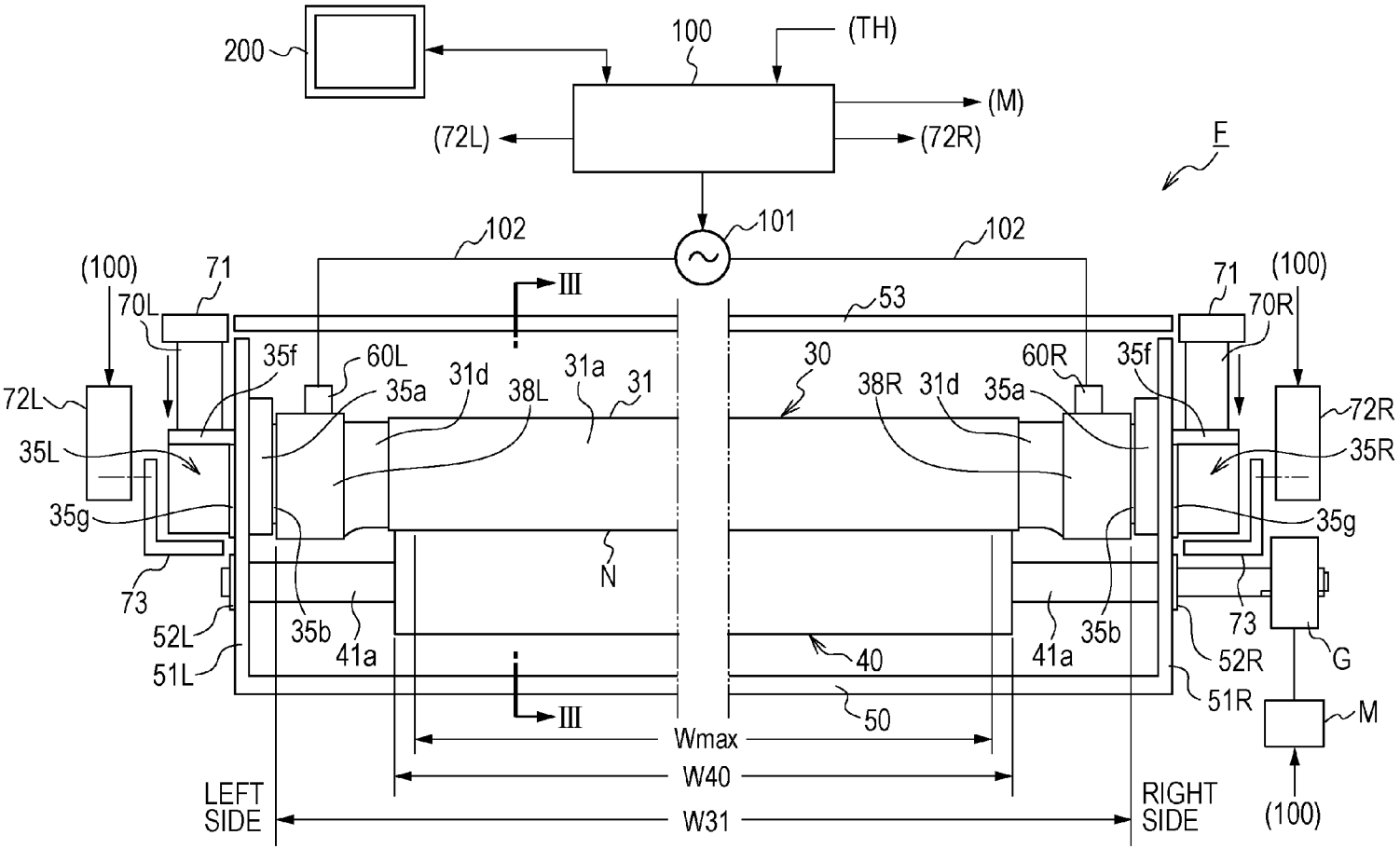
FIG. 2 is a front view of a fixing apparatus according to the exemplary embodiment.

FIG. 1 is a block diagram of the printer 1 serving as an image forming apparatus. FIG. 2 is a front view of a fixing apparatus F. The printer 1 forms an image on a sheet P according to image information input to a control circuit 100 from an external host device 200 (FIG. 2). The control circuit 100 is a circuit including a CPU that performs an operation associated with various controls, and a non-volatile medium such as a ROM in which various programs are stored. Programs are stored in the ROM and the CPU reads out the programs and executes the programs so as to execute various controls. Note that the control circuit 100 may be an integrated circuit such as an ASIC as long as similar functions can be performed.

The sheet P is a medium on which an image can be formed with the image forming apparatus and, for example, includes fixed size or non-fixed size standard paper, thick paper, an envelope, a postal card, a sticker, a resin sheet, an OHP film, and glossy paper.

An image forming unit 2 includes four image forming stations 3Y, 3M, 3C, and 3K for forming images of toner on the sheet P. Each station includes a rotary drum type photoconductor 4, a charging member 5, a laser scanner 6, a developer device 7, a transfer member 8, and a photosensitive drum cleaner 9. The stations 3Y, 3M, 3C, and 3K form toner images of yellow, magenta, cyan, and black, respectively.

The toner images formed in the stations 3Y, 3M, 3C, and 3K are superimposed on an intermediate transfer belt 11 such that an image t serving as a synthetic toner image is primarily transferred.

Meanwhile, the sheets P that are placed on either of the sheet cassettes 19 and 20, and the multi-feeding tray 21 are sent out sheet by sheet with a feeding mechanism (not shown) to a registration roller pair 23. Then the registration roller pair 23 synchronizes with the synthetic toner image on the intermediate transfer belt 11 and sends the sheet P between the intermediate transfer belt 11 and a secondary transfer roller 12. Accordingly, the image t on the intermediate transfer belt 11 is transferred onto the sheet P. Subsequently, the sheet P is sent towards the fixing apparatus (an image heating apparatus) F. Then, the fixing apparatus F applies heat and pressure to the image t on the sheet P so as to fix the image t on the sheet P.

(Fixing Apparatus)

Figure 3:
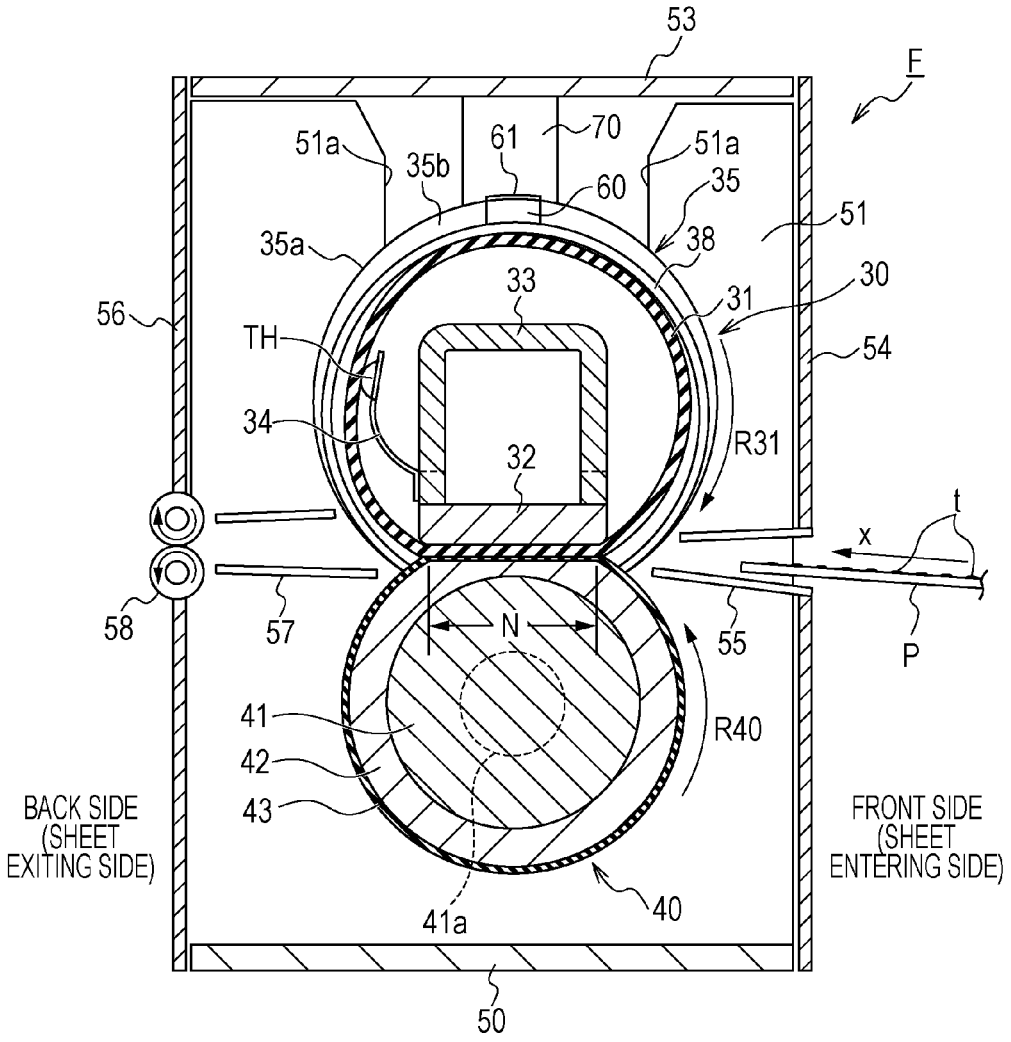
FIG. 3 is diagram viewed from the direction of arrow III-III in FIG. 2.
Figure 4:
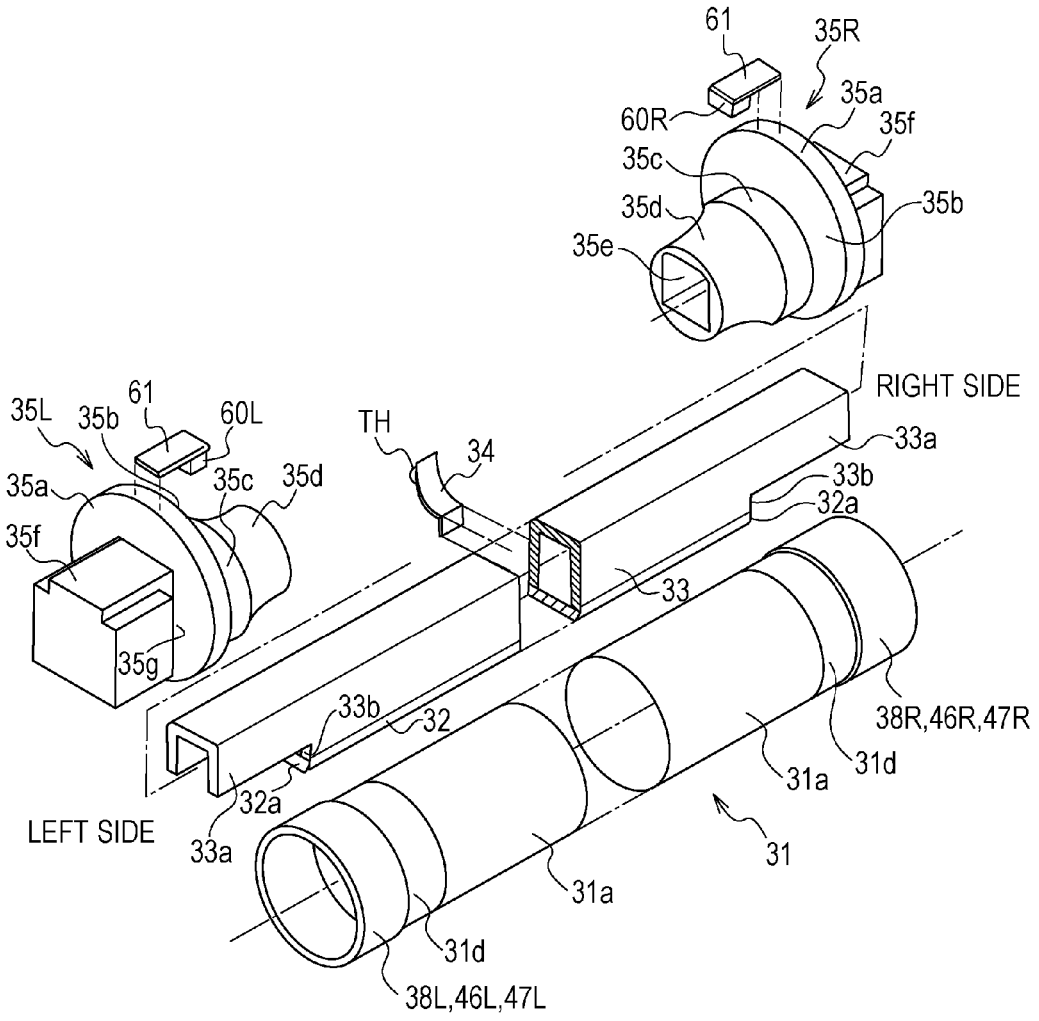
FIG. 4 is an exploded perspective view of a belt unit according to the exemplary embodiment.

A description of the fixing apparatus F will be given next. FIG. 3 is diagram viewed from the direction of arrow III-III in FIG. 2. FIG. 4 is an exploded perspective view of a belt unit according to the first exemplary embodiment.

The fixing apparatus F is an image heating apparatus that heats an image on a sheet with a belt unit (hereinafter, referred to as a unit 30) and a pressure roller 40 (hereinafter, referred to as a roller 40). The fixing apparatus F is a heat-generating fixing belt type fixing apparatus that employs, in the unit 30, a fixing belt 31 (hereinafter, referred to as a belt 31) that generates heat upon energization, and is capable of efficiently transmitting heat to the sheet P. Furthermore, the fixing apparatus F is a pressure roller driving type (a tensionless type) fixing apparatus that rotates the unit 30 with the roller 40 serving as a driving device. Accordingly, the unit 30 can be configured to have a low heat capacity such that the startup performance when starting fixing is excellent.

As illustrated in FIG. 2, the unit 30 and the roller 40 abutting against each other forms a nip portion N in between. Furthermore, as illustrated in FIG. 3, the roller 40 rotating in an arrow R40 direction and the belt 31 rotating in an arrow R31 direction convey the sheet P fed to the nip portion N in an arrow x direction. In the above, the heat of the unit 30 is added to the sheet P such that the image t on the sheet P is applied heat and pressure and is fixed to the sheet P in the nip portion N. The sheet P that has passed through the nip portion N is separated from the belt 31 and is ejected. In the present exemplary embodiment, the fixing process is performed in the manner described above. Hereinafter, the configuration of the fixing apparatus F will be described in detail with reference to the drawings.

Herein, as regards the fixing apparatus F of the present exemplary embodiment or the components of the fixing apparatus F, the front side is the surface of the apparatus viewed from the sheet entering side (FIG. 2) and the rear side is the surface on the other side (the sheet exiting side). Left and right refer to the left (the left side in FIG. 2 and the front side of the drawing in FIG. 3) and the right (the right side in FIG. 2 and the back side of the drawing in FIG. 3), respectively, when the apparatus is viewed from the front side. Upstream and downstream refers to the upstream side and the downstream side, respectively, with respect to a sheet conveying direction. Furthermore, a longitudinal direction (a width direction) and a sheet width direction refers to a direction that is substantially parallel to the direction (the left-right direction of FIG. 2) orthogonal to the conveying direction of the sheet P in the surface of the sheet conveying passage. A short direction refers to a direction that is substantially parallel to the conveying direction (left-right direction of FIG. 3) of the sheet P in the surface of the sheet conveying passage.

As illustrated in FIG. 3, the unit 30 includes the endless belt 31 that generates heat upon energization, a pressure pad 32 that is disposed inside the belt 31, and a pressure stay 33 serving as a pad holding member. As illustrated in FIG. 4, a power feed ring 38L serving as an electrode portion is attached on one edge side of the belt 31 in the longitudinal direction and a power feed ring 38R is attached on the other edge side, and feed of power from the power feed rings 38L and 38R generates heat in the belt 31. Details of the belt 31 and the power feed rings 38L and 38R would be described later. The pressure pad 32 (a nip pad: hereinafter referred to as a pad 32) is a heat insulating member that is long in the left-right direction and that has a substantially rectangular cross section. The pressure stay 33 (hereinafter referred to as a stay 33) is a rigid member that is long in the left-right direction and that has an inverted U-shaped cross section. It is desirable that the stay 33 is a member that does not easily warp even when high pressure is applied thereto and, for example, is a molded member of SUS304 (stainless steel). The pad 32 and the stay 33 are vertically arranged with respect to each other and are parallel to each other. The pad 32 is joined to leg portions of the stay 33. The pad 32 is a pressing member that is in contact with and that slides against an inner surface of the belt 31 at the nip portion N and that presses the belt 31 towards the roller 40 from the inside. Since the pad 32 performs a role of a guide that regulates the rotation path of the belt 31 at a portion in the vicinity of the nip portion N, a heat resisting property and a sliding property with respect to the inner surface of the belt are required.

As illustrated in FIG. 4, as the material for the pad 32, heat-resistance resin, such as a liquid crystal polymer, ceramics, and metal such as SUS may be used. A material such as SUS that has excellent sliding property may be used in the portion corresponding to the nip portion N, and heat-resistance resin, such as a liquid crystal polymer, that has excellent processing characteristics may be used in the guide portion. Furthermore, high-temperature grease may be coated on the surface that slides against the belt 31.

As illustrated in FIG. 4, a thermistor TH serving as a temperature sensor is disposed at substantially the middle portion of the stay 33 in the longitudinal direction through an elastic member 34 such as a plate spring. The belt 31 is loosely fitted to the outside of the assembly including the pad 32, the stay 33, the elastic member 34, and the thermistor TH. In the above case, the thermistor TH is in contact with the inner surface of the belt 31 in an elastic manner with a predetermined pressing force at substantially the middle portion of the belt 31 in the longitudinal direction with the elastic force of the elastic member 34.

The unit 30 includes terminal members 35L and 35R that are mounted on the two end portions side of the assembly described above. The terminal members 35L and 35R perform a role of regulating the movement of the belt 31 in the width direction and guiding the inner peripheral surfaces of the two edge portions of the rotating belt 31. The terminal members 35L and 35R are molded members of a heat resistant and electrically insulating resin and are disposed symmetrically in the left and right two edge portions of the belt 31.

As illustrated in FIG. 4, the terminal members 35L and 35R have flange portions (flange seat portions) 35*a* for receiving the edge faces of the power feed rings 38L and 38R with the abutting surfaces 35*b* on the inner surface sides.

Furthermore, guide portions 35*c* project from the flange portions 35*a* towards the center of the belt 31 in the longitudinal direction. The guide portions 35*c* fit inside the power feed rings 38L and 38R and guide the inner peripheral surface of the power feed rings 38L and 38R into a circular shape. Furthermore, circular portions 35*d* project from the guide portions 35*c* towards the center of the belt 31 in the longitudinal direction. The circular portions 35*d* are substantially coaxial with the guide portions 35*c* and have outside diameters that are smaller than those of the guide portions 35*c*.

Hole portions 35*e* are provided in the guide portions 35*c* of the terminal members 35L and 35R and the circular portions 35*d* that have small outside diameters and that continuously extend from the guide portions 35*c*. Left and right end portions 33*a* of the stay 33 are inserted in the hole portions 35*e*. Furthermore, pressure-receiving block portions 35*f* project from the flange portions 35*a* towards the outer side in the longitudinal direction of the belt 31. Vertical groove portions 35*g* (FIGS. 2 and 4) are provided in the pressure-receiving block portions 35*f*, and the terminal members 35L and 35R are engaged with side plates 51L and 51R.

Since the left and right end portions 33*a* of the stay 33 are inserted in the hole portions 35*e* of the terminal members 35L and 35R, the leg portions of the stay 33 in the end portions 33*a* are shorter than those in the longitudinal center portion. The pad 32 is joined to and held by the leg portions in the longitudinal center portion of the stay 33.

By sufficiently fitting and engaging the end portions 33*a* of the stay 33 to the hole portions 35*e*, the terminal members 35L and 35R become mounted as a portion of the unit 30. In the above state, the guide portions 35*c* are fitted inside the inner diameter portion of the power feed rings 38L and 38R of the unit 30.

As illustrated in FIG. 4, power feed members 60L and 60R are disposed at the apexes of the flange portions 35*a* of the terminal members 35L and 35R through the plate springs 61 formed of, for example, SUS. The power feed members 60L and 60R elastically abut against the outside diameter surfaces of the power feed rings 38L and 38R at the left and right two edge portions of the belt 31 with the spring forces of the plate springs 61. In other words, the power feed members 60L and 60R are in contact and are in electrical communication with the outside diameter surfaces of the left and right power feed rings 38L and 38R of the belt 31. Since an electrical current of 12 A flows between a power feed members 60 and the power feed rings 38, the contact area between each power feed member 60 and the corresponding power feed ring 38 is desirably 10 $mm^2$ or more. In the present exemplary embodiment, the width of a power feed member 60 in the longitudinal direction is 6 mm and the width thereof in the short direction is 2 mm.

Note that in the present exemplary embodiment, a metal brush is used as each of the power feed members 60L and 60R. Furthermore, in place of the metal brush, an electro conductive member such as a metal block or a carbon chip may be used.

The roller 40 is a nip forming member that forms the nip portion N with the unit 30 (the belt 31) while working together with the unit 30 (the belt 31). As illustrated in FIG. 3, the roller 40 is an elastic roller that includes an elastic layer 42 that is formed in a shape of a roller coaxially and integrally on an outer periphery of a core metal 41 formed of a metal material, and an insulating layer 43 formed of fluoro plastic further formed on an outer peripheral surface of the elastic layer 42. The material of the elastic layer 42 may be selected from heat-resistant rubber such as silicone rubber and fluoro rubber, and a foam body of silicone rubber. In order to convey the sheet P through the nip portion N in a stable manner without creating any crease in the sheet P, in the present exemplary embodiment, the shape of the outside diameter of the elastic layer 42 of the roller 40 is an inverted crown shape. Small diameter shaft portions 41*a* are provided in a coaxial and an integral manner with respect to the core metal 41 at the two left and right end portions of the core metal 41.

As illustrated in FIG. 2, the left and right small diameter shaft portions 41*a* of the roller 40 are disposed so as to be rotatably held between the side plates 51L and 51R of an apparatus frame 50 through bearing members 52L and 52R. A drive gear G is disposed in a coaxial and integral manner at the end portion of the small diameter shaft portion 41*a* on the right side. Driving force of a motor M (a drive source) that is controlled by the control circuit 100 is transmitted to the gear G through a motive power transmission mechanism (not shown). With the above, the roller 40 serving as a drive rotation member is rotationally driven in the direction (counterclockwise in FIG. 3) of the arrow R40 at a predetermined circumferential speed.

Meanwhile, the belt unit 30 is disposed on the upper side of the roller 40 in a substantially parallel manner with respect to the roller 40 such that the pad 32 abuts against the roller 40 through the belt 31. More specifically, the vertical groove portions 35*g* (FIGS. 2 and 4) provided in the left and right terminal members 35L and 35R of the unit 30 engage with vertical edge portions of vertical guide slits 51*a* (FIG. 3) provided in the left and right side plates 51L and 51R.

With the above, the left and right terminal members 35L and 35R are held by the left and right side plates 51L and 51R, respectively, while a slide motion in the vertical direction is allowed. In other words, the unit 30 is held so as to be able to perform a slide motion in the vertical direction with respect to the left and right side plates 51L and 51R.

As illustrated in FIG. 2, pressure springs (urging member) 70L and 70R are provided in a compressed manner between the pressure-receiving block portions 35*f* of the left and right terminal members 35L and 35R, and spring receiver seats 71 that are fixed and are disposed above the pressure-receiving block portions 35*f*. In a free state, the pressure springs 70L and 70R press the pressure-receiving block portions 35*f* of the terminal members 35L and 35R on the left and right side in a uniform manner with a predetermined downward pressing force. In the present exemplary embodiment, the pressing force on one end side is 156.8 N (16 kgf) and the total pressing force is 313.6 N (32 kgf).

With the above, through the stay 33 and the pad 32, the belt 31 counters the elasticity of the elastic layer 42 and comes in pressure contact (in a compressed state) against the upper surface of the roller 40 at a predetermined pressing force. Accordingly, a nip portion N having a predetermined width is formed between the unit 30 (the belt 31) and the roller 40 in the short direction (the sheet conveying direction).

Furthermore, the fixing apparatus F includes pressure release mechanisms 72L and 72R that counter the pressing force of pressure springs 70L and 70R and that lift up the left and right terminal members 35L and 35R so as to release the compressed state with respect to the roller 40 of the belt 31. Specifically, the pressure release mechanisms 72L and 72R move lifters 73 according to an instruction from the control circuit 100 so as to determine the held positions of the terminal members 35L and 35R.

By moving the terminal members 35L and 35R to predetermined lift positions, the overall unit 30 moves in a direction that separates itself from the roller 40 and the belt 31 is spaced apart from the roller 40 such that a pressure released state is maintained. Furthermore, upon descending of the lifters 73 from the pressure released state, the terminal members 35L and 35R are lifted down. Then, by moving the lifters 73 to predetermined descending positions, which are non-acting positions of the lifters 73 with respect to the terminal members 35L and 35R, the compressed state is reached again.

Although a specific configuration of the pressure release mechanisms 72L and 72R is not drawn, mechanisms each using an electromagnetic solenoid or mechanisms each using a cam and a motor, for example, may be adopted. Furthermore, the pressure release mechanisms 72L and 72R may adopt a configuration that uses a common mechanism for the left and right terminal members 35L and 35R.

In FIG. 2, the total width of the belt 31 is indicated by W31 and the width of the roller 40 other than the small diameter shaft portions 41*a* is indicated by W40. The width W40 of the roller 40 is smaller than the total width W31 of the belt 31 by a predetermined length. The length of the stay 33 excluding the left and right end portions 33*a* is substantially the same as the width W40 of the roller 40. The length of the pad 32 is substantially the same as the width W40 of the roller 40. The width of the nip portion N in the longitudinal direction is the same as the width W40 of the roller 40. In the present exemplary embodiment, W31 is 320 mm and W40 is 340 mm.

The left and right power feed rings 38L and 38R of the belt 31 are positioned on the outside in the longitudinal direction with respect to the end portions of the roller 40 (end portions of the nip portion N). Wmax is a conveyance area width of the maximum sheet width (the maximum sheet passing width) that can be used in the fixing apparatus F and is small by a predetermined amount than the width W40 of the nip portion N. The width of the resistance heat generating layer 31*b* of the belt 31 (the width of the effective heating area of the belt 31) in the present exemplary embodiment is larger than the sheet conveyance area width Wmax and is smaller than the width W40 of the nip portion N.

As illustrated in FIG. 3, the fixing apparatus F includes an upper side cover plate 53, a front side cover plate 54, an entering side guide plate 55, a rear side cover plate 56, an exit side guide plate 57, and a fixing discharge roller pair 58. The fixing discharge roller pair 58 is rotationally driven in a predetermined direction at a predetermined circumferential speed by transmission of a driving force of the roller 40 through an interlocking mechanism (not shown). The electro conductive elastic support members 61 of the left and right power feed members 60L and 60R are electrically connected to a power supply circuit 101 (an AC power source) through wires 102. Furthermore, the thermistor TH is electrically connected to the control circuit 100 through a wire (not shown).

(Fixing Operation)

In the fixing apparatus F, when a start signal of a print job is input, the control circuit 100 controls the power supply circuit 101 and starts energization of the resistance heat generating layer 31*b* (hereinafter, referred to as a heat generating layer 31*b*) of the belt 31 with a predetermined energization control pattern.

In other words, voltage is applied to the left and right power feed rings 38L and 38R through the left and right power feed members 60L and 60R. With the above, the heat generating layer 31*b* is energized through an electrode layer 31*d* (FIGS. 5A and 5B) described later that is in electrical communication with the power feed rings 38L and 38R. Furthermore, the belt 31 is heated all around in the width of the effective heating area by heat generation of the heat generating layer 31*b* caused by the energization.

When electrical information relating to the temperature of the belt 31 is input to the control circuit 100 from the thermistor TH, the control circuit 100 determines the energization control pattern on the basis of the detection temperature of the belt 31. Then, on the basis of the determined energization control pattern, the power supply circuit 101 is controlled through phase control/frequency control or the like such that an appropriate electric power is supplied to the heat generating layer 31*b*.

Furthermore, the control circuit 100 starts up the motor M and starts rotational driving of the roller 40 serving as a drive rotation member.

The roller 40 is rotationally driven in the counterclockwise direction of the arrow R40 in FIG. 3 at a predetermined circumferential speed. When the roller 40 is rotationally driven, running torque acts on the belt 31 with the frictional force in the nip portion N between the roller 40 and the outer surface of the belt 31. With the above, the belt 31 is driven and is rotated in the arrow R31 direction (clockwise direction in FIG. 3) at a circumferential speed that substantially corresponds to the rotational circumferential speed of the roller 40.

The rotating belt 31 deviates and moves towards the left or the right along the longitudinal direction of the pad 32; however, the deviation and movement are regulated to a predetermined range with the flange portions 35*a* of the left and right terminal members 35L and 35R. In detail, the flange portions 35*a* of the left and right terminal members 35L and 35R receive the motion of the power feed rings 38L and 38R that rotate together with the belt 31. Furthermore, the guide portions 35*c* guide the inner peripheral surfaces of the power feed rings 38L and 38R that rotate together with the belt 31. Subsequently, the control circuit 100 starts the image forming operation of the image forming unit when the thermistor TH detects a further higher temperature (a job start temperature) that is higher than a first temperature (a standby temperature). Then, the sheet P on which the image t has been transferred is conveyed to the fixing apparatus F. On the other hand, when the thermistor TH detects a third predetermined temperature (a fusing temperature) that is higher than the second predetermined temperature, the control circuit 100 turns the energization of the heat generating layer 31*b* of the belt 31 to a temperature adjustment control state. In the temperature adjustment control state, the power supply circuit 101 performs energization control on the heat generating layer 31*b* using, for example, PI control so that the third predetermined temperature, in which the temperature of the belt 31 is a fusing temperature, is maintained at a substantially uniform temperature.

When the sheet P on which the image t has been transferred is conveyed to the fixing apparatus F, the sheet P is guided to the entering side guide plate 55, enters the nip portion N, and is nipped and conveyed. With the above, the image t and the sheet P are heated and compressed such that the image t is fixed to the sheet P as a fixed image. In the present embodiment, while the sheet P is introduced into the fixing apparatus F based on a so-called center reference, which sets the center of the sheet width as a reference, not limited to the center reference, a so-called one-side reference may be set. The sheet P that has exited the nip portion N is separated from the belt 31, is guided to the exit side guide plate 57, enters the nip portion N of the fixing discharge roller pair 58, and is ejected and conveyed.

After a predetermined print job of a single piece of sheet or a plurality of pieces of sheet in succession is completed, the control circuit 100 stops the energization of the heat generating layer 31*b* of the belt 31. Furthermore, the control circuit 100 stops driving of the motor M. In the above state, the control circuit 100 sets the fixing apparatus F in a waiting state until the next print job start signal is input.

(Configuration of Belt)

Figure 5A:
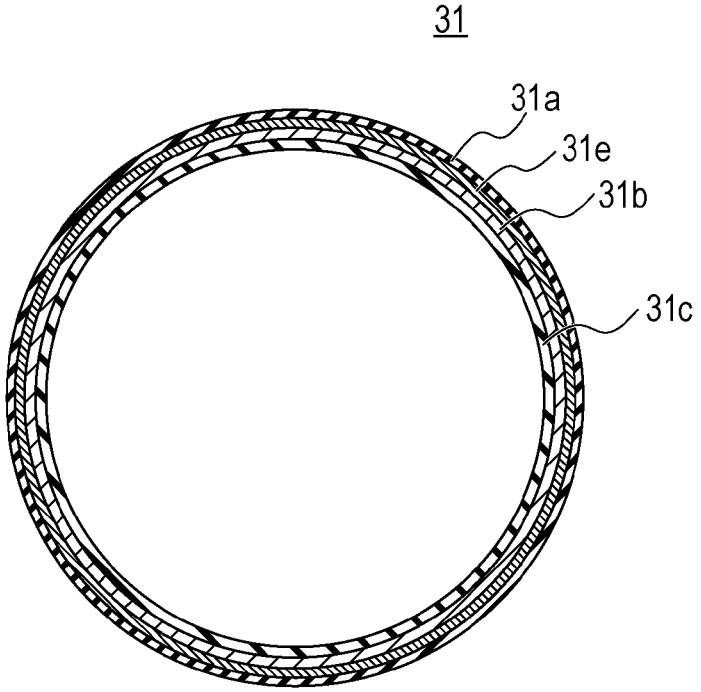
FIGS. 5A and 5B are diagrams for describing a layer configuration of a belt of the exemplary embodiment.
Figure 5B:
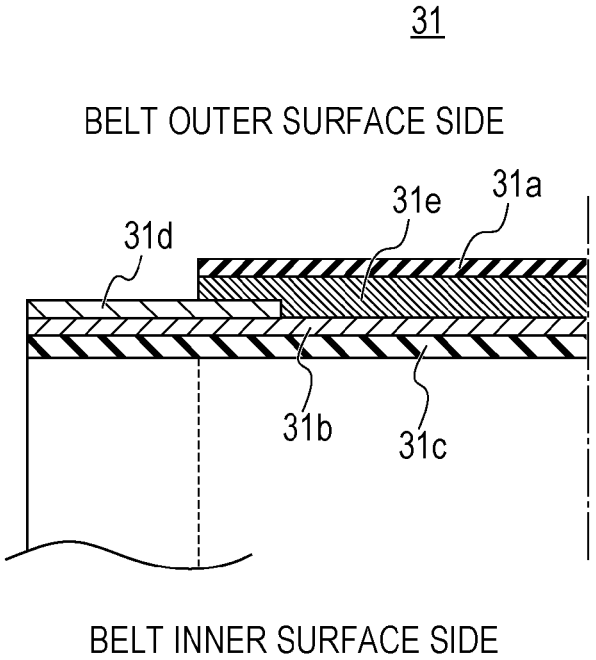

FIG. 5A is a schematic diagram of a cross section of the heat generating layer of the belt 31. FIG. 5B is a schematic diagram of a cross section illustrating a layer configuration of a left edge portion of the belt 31. Since the belt 31 is symmetrical in the left and right in the longitudinal direction, a layer configuration of the right edge portion of the belt 31 is similar to that of FIG. 5B.

The overall belt 31 is a flexible endless member (an endless belt). The belt 31 has a width that is larger than that of the roller 40 so that the power feed rings 38 can be attached to the two edge portions of the belt 31 in the longitudinal direction. As illustrated in FIGS. 5A and 5B, the belt 31 has a structure having at least three layers in which, in order from the outside to the inside, an insulating layer 31*a*, the heat generating layer 31*b* that generates heat when power is fed thereto, and a cylindrical insulating base material 31*c* (hereinafter, referred to as a base material 31*c*) are stacked. In the present exemplary embodiment, in order to improve the fixing characteristics, an elastic layer 31*e* is provided between the insulating layer 31*a* and the heat generating layer 31*b*. At the two edge portions of the heat generating layer 31*b* in the longitudinal direction, electrode layers 31*d* serving as conductive layers are provided all around the outer surfaces. In the present exemplary embodiment, the electrode layers 31*d* are each provided in the 15 mm area of the corresponding one of the two edge portions of the belt 31 in the longitudinal direction.

The base material 31*c* is a member that maintains the strength of the belt 31 and is flexible, being capable of deforming in the circumferential direction. The base material 31*c* is a member having an insulation property. As the material of the base material 31*c*, a resin belt formed of, for example, polyimide, polyimide-amide, PEEK, PTFE, PFA, and FEP, and furthermore, a metal belt formed of SUS, nickel, or the like may be used. Note that PEEK is polyetheretherketone, PTFE is polytetrafluoroethylene, PFA is perfluoroalkoxy alkane, FEP is perfluoroethylene-propene copolymer. However, when too thin, the base material 31*c* is easily damaged, and when too thick, the base material 31*c* does not easily deform itself; accordingly, it is desirable to use a heat-resistance resin material, such as polyimide, having a thickness of 20 μm or more to 100 μm or less. In the present exemplary embodiment, a cylindrical polyimide belt having a thickness of 50 μm and an inside diameter of 24 mm is used.

The elastic layer 31*e* is a layer to facilitate the belt 31 follow the uneven surface of the sheet P and to improve the fixing characteristics. In order to reduce the heat capacity and improve the quick starting property, silicone rubber and fluoro rubber materials of high thermal conductivity that are 400 μm or under in thickness are used.

The heat generating layer 31*b* is a layer that is formed on the outer peripheral surface of the base material 31*c* and that generates heat upon energization. As for the material of the heat generating layer 31*b*, a material in which electro conductive carbon and metal powders are distributed in a heat-resistance resin, such as polyimide, may be used. In the present exemplary embodiment, a coat layer of a resistance heating element that is formed of polyimide in which carbon is distributed and that has a thickness of 25 μm is used. The carbon distribution amount and the like is adjusted such that the resistance value in the portion between the left and right electrode layers 31*d* on the two edge portions side of the belt 31 is 10Ω at normal temperature. Accordingly, when 100 V is applied, the heat generating layer 31*b* generates heat with an electric power of about 1000 W.

The insulating layer 31*a* is formed on the entire heat generating layer 31*b* and a portion of the electrode layers 31*d* on the heat generating layer 31*b* side. The insulating layer 31*a* prevents electric current from flowing into portions other than the belt 31 and prevents the belt from becoming dirty due to adhesion of toner and the like. The insulating layer 31*a* is required to have release characteristics with respect to the toner and, since the insulating layer 31*a* is in contact with the electrode layers 31*d* and the heat generating layer 31*b*, is required to have an insulation property so that no electric current flows therein; accordingly, a fluoro plastic material having an insulation property such as PFA or PTFE may be used.

If the insulating layer 31*a* is too thin, the life becomes short due to wear caused by friction with the sheet P and the roller 40, and if too thick, the heat capacity will increase and the transmission of heat will be reduced and the energy saving property may disadvantageously be degraded; accordingly, it is desirable to use a fluoro plastic material of 10 to 50 μm. In the present exemplary embodiment, an insulating PFA resin tube of 20 μm in thickness is used.

The electrode layers 31*d* are layers to evenly energize the whole circumference of the heat generating layer. It is desirable that the resistivity of the electrode layers 31*d* are sufficiently lower than the resistivity of the heat generating layer 31*b*, and in the present exemplary embodiment, a material having conductive characteristics including silver-palladium is used and the thickness thereof is 10 μm.

Note that as long as the adhesiveness between the power feed rings 38 and the belt 31 are satisfactory and unevenness in energization can be suppressed, the electrode layers 31*d* do not necessarily have to be provided.

Note that in the present exemplary embodiment, while the electrode layers 31*d* are provided on the heat generating layer 31*b*, the configuration of the belt 31 is not limited to the above. For example, the heat generating layer 31*b* on the base material 31*c* and the electrode layers 31*d* may be provided side by side.

(Power Feed Ring)

Figure 6A:
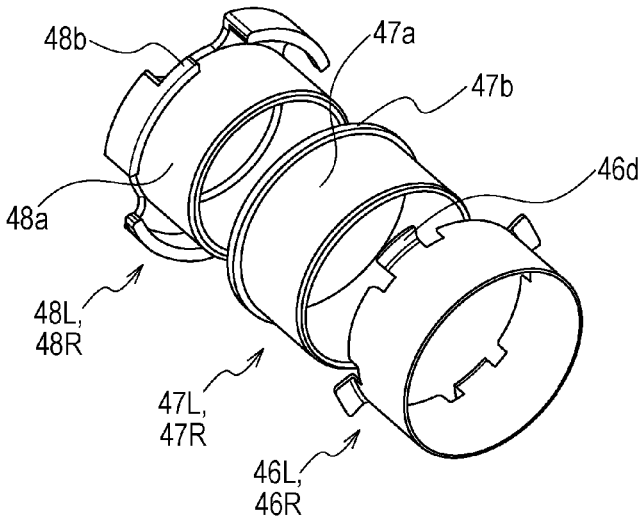
FIGS. 6A to 6C are diagrams for describing a configuration of a power feed ring of the exemplary embodiment.
Figure 6B:
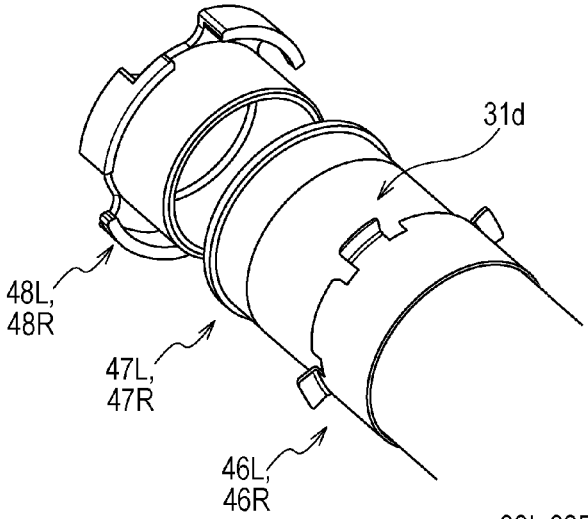
Figure 6C:
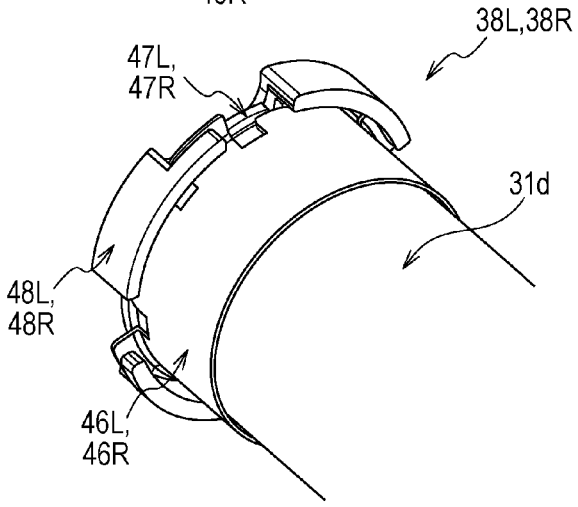
Figure 7:
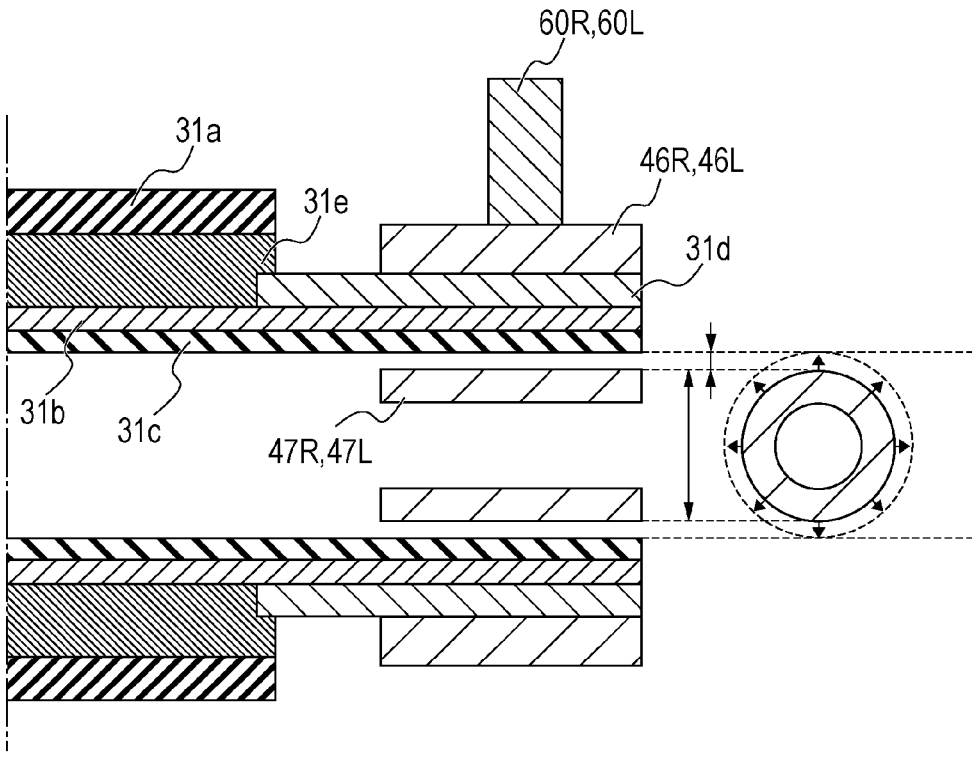
FIG. 7 is a partial cross-sectional view of the fixing apparatus according to the exemplary embodiment.

A configuration of the power feed rings 38L and 38R will be described in detail next. FIGS. 6A to 6C are diagrams for describing a configuration of the power feed ring 38L of the present exemplary embodiment. FIG. 7 is a partial cross-section view of the fixing apparatus according to the present exemplary embodiment.

The fixing apparatus F of the present exemplary embodiment has a left and right symmetrical structure in which the power feed ring 38L is provided on one end of the belt 31 in the longitudinal direction and the power feed ring 38R is provided on the other end. Accordingly, the power feed ring 38L will be used as an example in the following description. The power feed ring 38L includes an outer ring 46L serving as a first ring-shaped member, an inner ring 47L serving as a second ring-shaped member, a fixing ring 48L serving as a fixing member (a ring-shaped holding member). The power feed ring 38R includes an outer ring 46R serving as a third ring-shaped member, an inner ring 47R serving as a fourth ring-shaped member, a fixing ring 48R serving as another fixing member (a ring-shaped holding member). Hereinafter, the power feed rings 38L and 38R will be collectively referred to as power feed rings 38. The outer rings 46L and 46R will be collectively referred to as outer rings 46. The inner rings 47L and 47R will be collectively referred to as inner rings 47. The fixing rings 48L and 48R will be collectively referred to as fixing rings 48. The power feed members 60L and 60R will be collectively referred to as power feed members 60.

By combining the members described above, the power feed rings 38 are joined to the edge portions of the belt 31 and function as electrode portions that are capable of rotating in an integrated manner with the belt 31. The power feed rings 38 are rigid and do not easily become warped such that the rotation paths are each close to a perfect circle. Accordingly, the abutting state against the power feed members 60 can be maintained in a satisfactory manner. In other words, while conventional methods that does not use the power feed rings 38 and that directly abuts the power feed member against the electrode layer of the belt 31 encounter a problem in that a conduction failure occurs with the power feed member due to vibrations of the electrodes, the present exemplary embodiment has overcome the problem. Furthermore, different from conventional methods, in the present exemplary embodiment, the power feed members 60 do not directly come in contact with the electrode layers 31*d*. Accordingly, peeling off of the electrode layer due to wear of the surface of the electrode layer can be prevented and increase in the life of the belt 31 can be achieved.

Furthermore, in the present exemplary embodiment, the power feed rings 38 are devised so that the adhesiveness between the power feed rings 38 and the belt do not become lower due to thermal expansion of the outer rings 46. Specifically, the materials of the inner rings 47 and the outer rings 46 are selected so that a coefficient of linear expansion of the inner rings 47 is larger than a coefficient of linear expansion of the outer rings 46. In such a configuration, since the amount of change in the outside diameter of the inner rings 47 caused by thermal expansion is larger than the amount of change in the inside diameter of the outer rings 46 caused by thermal expansion, the power feed rings 38 and the belt 31 can be adhered to each other regardless of the temperature of the power feed rings 38. Detailed description will be given below using the drawings.

The outer rings 46 are electro conductive members that fit outside the annular electrode layers 31*d* on the outer peripheral surface sides of the edge portions of the belt 31. Since the outer rings 46 are used as an energization path that electrically communicates the power supply circuit 101 and the belt 31 to each other, desirably, a metal with low electric resistance is used. Furthermore, in order for the power feed members 60 to be in contact in a stable manner, the outer rings 46 are, desirably, members with high rigidity that can maintain the shape close to a perfect circle. In the present exemplary embodiment, a ring-shaped member that is made by pressing a copper plate with a thickness of 1 mm is used as each of the outer rings 46. Furthermore, protrusion portions 46*d* are provided in one edge portion of each outer rings 46. Note that the outer rings 46 abut against the power feed members 60 in a slidable manner and perform electrical connection.

The inner rings 47 are members that are disposed to face the outer rings 46 through the belt 31. In the present exemplary embodiment, a ring-shaped member that is made by pressing an aluminum plate with a thickness of 1 mm is used as each of the inner rings 47. The inner rings 47 each include an annular portion 47*a* that is inserted in the inner peripheral surface side of the edge portion of the belt 31, and a flange portion 47*b* that has a diameter that is larger than the belt diameter. Details of the inner rings 47 will be described later.

Fixing rings 48 are ring-shaped members that fix the inner rings 47 and the outer rings 46 to each other. The fixing rings 48 include annular portions 48*a* that are inserted in the inner surfaces of the inner rings 47, and hook portions 48*b* at the edge portions. In the present exemplary embodiment, a PPS resin (a polyphenylene sulfide resin) that is excellent in resisting heat is used as the material of the fixing rings 48. Note that the inside diameter and the outside diameter of each ring described later represents the dimension of the annular portion of each ring.

Furthermore, the outer rings 46 and the inner rings 47 are disposed so as to pinch the front and back surfaces of the edge portions of the belt 31, and the fixing rings 48 fixing the above form the power feed rings 38.

Specifically, by having protrusion portions 46*d* be caught in the hook portions 48*b* of the fixing rings 48, the positions of the outer rings 46 in the longitudinal direction of the belt 31 are fixed to the edge portions. Furthermore, by having the flange portions 47*b* be caught between the fixing rings 48 and the outer rings 46, the positions of the inner rings 47 in the longitudinal direction of the belt 31 are fixed to the edge portions. In other words, the fixing rings 48 hold the outer edge portions of the outer rings 46 and hold the outer edge portions of the inner rings 47 to integrally fix the outer rings 46 and the inner rings 47 to each other. Furthermore, the inner rings 47 and the outer rings 46 being in close contact with the belt 31 enables the power feed rings 38 to rotate in an integrated manner with the belt 31.

Note that while in the present exemplary embodiment, the inner rings 47 and the outer rings 46 are fixed with the fixing rings 48, the fixing method is not limited to the above. For example, holes may be made at corresponding positions of the inner rings 47 and the outer rings 46 and a screw or the like may be fixed therein so as to fasten the inner rings 47 and the outer rings 46 to each other.

Incidentally, the power feed rings 38 attached in the above manner to the belt 31 that generates heat gradually becomes heated as the fixing process proceeds. Accordingly, the outer rings 46, the material of which is metal (copper in the present exemplary embodiment), expand as the temperatures thereof rises and the diameters thereof becomes larger. Furthermore, when the diameters of the outer rings 46 become larger, the adhesiveness between the inner peripheral surfaces of the outer rings 46 and the outer peripheral surface of the belt 31 (the electrode layers 31*d* in the present exemplary embodiment) is lowered and the contact areas of the above are reduced. With the above, there may be cases in which feed of power to the belt 31 becomes disadvantageously unstable and the belt 31 disadvantageously causes heat generation failure. Furthermore, there may be cases in which the life of the belt 31 is disadvantageously shortened due to local heat generation caused by the electric current flowing locally in the belt 31 from the outer rings 46 and due to electric discharge between the outer rings 46 and the belt 31.

Accordingly, in the present exemplary embodiment, in order to overcome the above problem, aluminum, as described above, is used as the material for the inner rings 47. Specifically, investigation had been made on the material used for the inner rings 47 in the below manner.

When the diameter of the cylindrical member at normal temperature (25° C.) is $D_0$, the linear expansion coefficient of the cylindrical member is $\alpha$, and the temperature variation is $\Delta T$, then, the diameter D of the cylindrical member that thermally expands is expressed by the following equation.

$$D=D_0(1+\alpha\Delta T) \quad (1)$$

Accordingly, a gap X that is the difference between the inside diameter of each outer ring 46 and the outside diameter of the corresponding inner ring 47 is expressed by the following equation.

$$X=D_1(1+\alpha_1\Delta T)-D_2(1+\alpha_2\Delta T), \quad (2)$$

where the inside diameter of each outside ring 46 at normal temperature is $D_1$, the linear expansion coefficient of each outer ring 46 is $\alpha_1$, the outside diameter of each inner ring 47 at normal temperature is $D_2$, and the linear expansion coefficient of each inner ring 47 is $\alpha_2$.

As can be understood from equation (1), the variation of the diameter of the cylinder is $D_0\alpha\Delta T$. In other words, when $\alpha\Delta T$ is constant, the larger the diameter $D_0$, the variation in the diameter of the cylinder is large. Accordingly, it can be understood that, since the diameter of the inner rings 47<the diameter of the outer rings 46, when the outer rings 46 and the inner rings 47 using the same material are placed under the same temperature environment, then, the higher the environmental temperature, the more diameter difference between the outer rings 46 and the inner rings 47 occur. In other words, when the same material is used for the outer rings 46 and the inner rings 47, as the temperature increases, the gap X between the outer rings 46 and the inner rings 47 become larger and the force pinching the belt 31 decreases. Accordingly, one can conceive of using a material, for the inner rings 47, that is different with the material of the outer rings 46. Table 1 illustrates linear expansion coefficients (coefficient of linear expansion [$\times10^{-6}$/° C.]) of representative metal materials.

TABLE 1

Coefficient of Linear Expansion [$\times10^{-6}$/° C.] of Representative Materials

| Material | Coefficient of Linear Expansion [$\times10^{-6}$/° C.] |
|---|---|
| Aluminum | 23.9 |
| Silver | 19.7 |
| Titanium | 8.5 |
| Iron | 11.7 |
| Copper | 16 |
| Nickel | 13.3 |
| SUS410 | 10.4 |
| SUS304 | 17.3 |

As illustrated in table 1, the linear expansion coefficient of copper used in the outer rings 46 of the present exemplary embodiment is 16 [$\times10^{-6}$/° C.]. Accordingly, as the material of the inner rings 47, aluminum (linear expansion coefficient: 23.9 [$\times10^{6}$/° C.]) having a linear expansion coefficient that is larger than that of copper has been selected.

A configuration of the power feed rings 38 will be described next. In the present exemplary embodiment, the power feed rings 38 pinch areas of the belt 31 that have a thickness of 80 μm (the base material 31*c* is 50 μm, the heat generating layer 31*b* is 25 μm, the electrode layers 31*d* are 5 μm). Furthermore, in consideration of the ease of assembling the power feed rings 38 to the belt 31, the inside diameters of the outer rings 46 and the outside diameters of the inner rings 47 are provided with an intersection of 10 μm. Accordingly, the inside diameters of the outer rings 46 are designed so as to be 40.09 mm, the outside diameters of the inner rings 47 are designed so as to be 39.99 mm. Based on the above details, the size of the gap X is obtained by equation (2).

Figure 9:
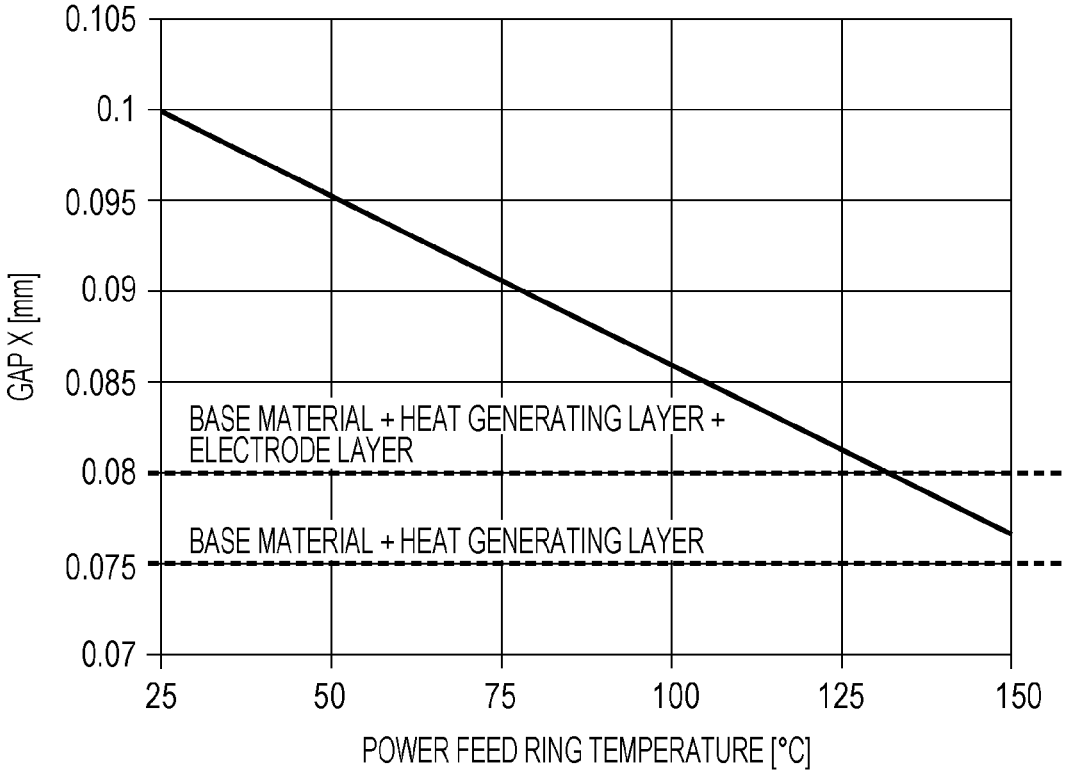
FIG. 9 is a diagram illustrating a relationship between a gap between an outer ring and an inner ring, and a temperature.

FIG. 9 is a diagram illustrating the relationship between the temperature of the power feed ring 38 and the gap X. As illustrated in FIG. 9, it can be understood that as the temperature of the power feed ring 38 rises, the gap becomes smaller. Specifically, while the fixing process is continuously performed in the fixing apparatus F, when the power feed ring 38 reaches 150° C., the gap X is 77 μm. The above gap X is smaller than the thickness (80 μm) of the pinched portion (the base material 31*c*+heat generating layer 31*b*+the electrode layer 31*d*) of the belt 31. As described above, in the present exemplary embodiment, when the belt 31 is heated, the inner rings 47 are thermally expanded in a greater manner with respect to the thermal expansions of the outer rings 46. In other words, the difference obtained by subtracting the diameter of the inner ring 47 at normal temperature from the diameter of the inner ring 47 at the temperature (150° C.) during fixing that is higher than the normal temperature (25° C.) is set equivalent to or larger than the difference obtained by subtracting the diameter of the outer ring 46 at normal temperature from the diameter of the outer ring 46 at the temperature during fixing. Accordingly, as illustrated in FIG. 9 the size of the gap X becomes narrower as the temperature of the power feed ring 38 becomes higher. In other words, when the power feed ring 38 is at the temperature during fixing, the difference obtained by subtracting the outside diameter of the inner ring 46 from the inside diameter of the outer ring 47 is smaller than the difference obtained when the power feed ring 38 is at normal temperature. Accordingly, the power feed rings 38 are capable of firmly pinching the belt 31.

(Effect of Present Exemplary Embodiment)

Figure 8A:
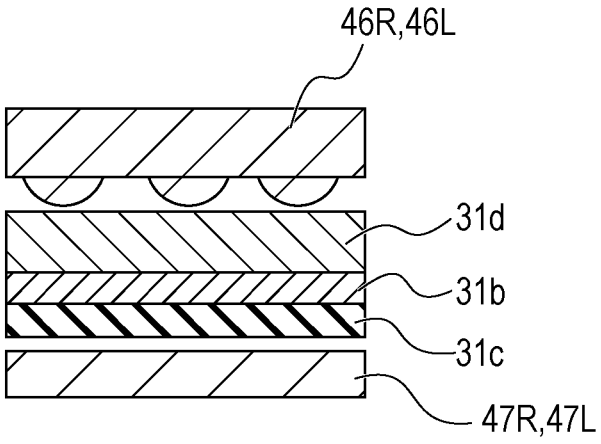
FIGS. 8A and 8B are diagrams for describing the effects of the exemplary embodiment.
Figure 8B:
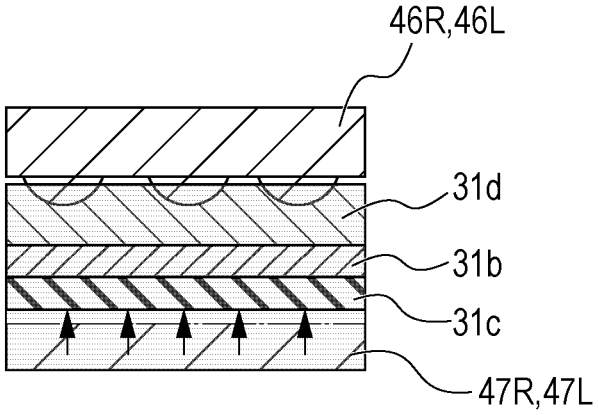

With the configuration described above, the fixing apparatus F of the present exemplary embodiment stabilizes the electric connection between the belt 31 and the power feed rings 38. Specifically, when the belt 31 is heated, the inner rings 47 are thermally expanded in a greater manner with respect to the thermal expansion of the outer rings 46 so that the belt 31 is pressed towards the outer rings 46 with the inner rings 47, thus, increasing the adhesiveness between the electrode layers 31*d* and the outer rings 46. FIGS. 8A and 8B are diagrams for describing the effects of the present exemplary embodiment.

Since the outer rings 46 have quite some surface roughness, there are quite some surface unevenness on the inner peripheral surface of the outer rings 46. Accordingly, as illustrated in FIG. 8A, when the outer rings 46 and the electrode layers 31*d* are in contact with each other in a subtle manner, the contact areas between the outer rings 46 and the electrode layers 31*d* are small. Accordingly, in the above state, the life of the belt 31 may disadvantageously become shortened due to local heat generation caused by a flow of electric current from the outer rings 46 into the belt 31 in a local manner and due to electric discharge created by minute gaps between the outer rings 46 and the belt 31. In the present exemplary embodiment, since the inner rings 47 press the belt 31 towards the outer rings 46, the relationship between the inner peripheral surfaces of the outer rings 46 and the electrode layers 31*d* can be brought to a state illustrated in FIG. 8B. In other words, the uneven surfaces of the inner peripheral surfaces of the outer rings 46 are pushed into the electrode layers 31*d* and, accordingly, the outer rings 46 and the electrode layers 31*d* can be brought to a state with large contact surfaces. Accordingly, in the present exemplary embodiment, the problem illustrated in FIG. 8A is suppressed from occurring.

An endurance test was conducted on the fixing apparatus F of the present exemplary embodiment and a fixing apparatus F of a comparative example in order to verify the effect of the present exemplary embodiment. Note that the fixing apparatus F of the comparative example uses copper as the material of the inner rings 47; other configurations are similar to that of the present exemplary embodiment. A test of continuously performing processes on up to 200K sheets of A4-sized sheets P were conducted with the above-described two fixing apparatuses F. The results are illustrated in table 2. Table 2 is a table that compares the present exemplary embodiment and the comparative example with each other on the occurrence of burn outs of the electrode layers.

TABLE 2

Occurrence of Burn out of Electrode Layer and Number of Sheets P on Which Processes Have Been Performed

| | Comparative Example | Exemplary Embodiment |
|---|---|---|
| Burn Out of Electrode Layer | Occurred on 150K$^{th}$ sheet | Did not occur on 200K$^{th}$ sheet |

As illustrated in table 2, in the comparative example, at around when the 150K$^{th}$ sheet P was processed, a burn out on the surface of the electrode layer 31*d* was identified; however, no burn out was identified in the present exemplary embodiment. For verification, the endurance test was conducted on the fixing apparatus F of the present exemplary embodiment until the process was performed on the 200K$^{th}$ sheet P, even so, no burn out was identified in the electrode layers 31*d*. As described above, stable electrical connections between the inner peripheral surfaces of the outer rings 46 and the electrode layers 31*d* were verified in the present exemplary embodiment.

Note that while in the present exemplary embodiment, copper is used for the material of the outer rings 46, and aluminum is used for the material of the inner rings 47, the combination of the materials is not limited to the above. Any other combination of the materials in which the linear expansion coefficient of the outer rings 46<the linear expansion coefficient of the inner rings 47 is satisfied may be adopted.

Furthermore, in the present exemplary embodiment, when the fixing process is performed, the power feed rings are firmly fixed to the belt 31. Accordingly, when assembling the fixing apparatus F, the power feed rings 38 can be easily mounted on the belt 31 and sufficient amount of intersection can be provided to the outer rings 46 and the inner rings 47.

OTHER EXEMPLARY EMBODIMENTS

A description of the exemplary embodiment to which the present disclosure can be applied has been given above; however, the numerical values such as the dimension and the like exemplified in the exemplary embodiment are examples and the present disclosure is not limited by the numerical values. The numerical values can be appropriately selected within the scope of the disclosure. Furthermore, the configuration described in the exemplary embodiment may be appropriately modified within the scope of the disclosure.

The belt 31 is not limited to the configuration in which the inner surface of the belt 31 is supported by the pad 32 and in which the belt 31 is driven by a roller 40. For example, the belt 31 may be a belt of a belt unit type in which the belt is bridged across a plurality of rollers and that is driven by one of the plurality of rollers. However, from the viewpoint of lowering the heat capacity, a configuration such as that of the exemplary embodiment is desirable.

The member forming the nip forming member is not limited to a roller member such as the roller 40. For example, a pressure belt unit that bridges a belt across a plurality of rollers may be used.

The image forming apparatus that has been described with the printer 1 as an example is not limited to the image forming apparatus that forms a full color image, and may be an image forming apparatus that forms a monochrome image. Furthermore, the image forming apparatus may be implemented for various purposes, such as for a copier, a fax machine, or a multi-functional apparatus that is provided with a plurality of the above functions.

The image heating apparatus that has been described above is not limited to the fixing apparatus that fixes an unfixed toner image on the sheet P. For example, the image heating apparatus may be an apparatus that fixes a half-fixed toner image on the sheet P, or may be an apparatus that performs a heat treatment on a fixed image. Accordingly, the image heating apparatus may be used as, for example, a surface heating apparatus that adjusts the glossiness and the surface properties of an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-229324, filed Nov. 11, 2014, which is hereby incorporated by reference herein in its entirety.

What is claimed is:

1. An image heating apparatus, comprising:

a flexible endless belt configured to heat a toner image on a sheet, said endless belt including a heat generating layer configured to generate heat by an electric energization;

a first outer ring-like member provided on one longitudinal end of said endless belt along an outer surface of said endless belt and configured to electrically connect with said heat generating layer;

a first inner ring-like member provided on the one longitudinal end of said endless belt along an inner surface of said endless belt and configured to back up said first outer ring-like member through said endless belt;

a second outer ring-like member provided on the other longitudinal end of said endless belt along an outer surface of said endless belt and configured to electrically connect with said heat generating layer to form an energization path between said second outer ring-like member and a second inner ring-like member through said heat generating layer, wherein the second inner ring-like member is provided on the other longitudinal end of said endless belt along an inner surface of said endless belt and configured to back up said second outer ring-like member through said endless belt, wherein a linear expansion coefficient of said first inner ring-like member is larger than a linear expansion coefficient of said first outer ring-like member, and a linear expansion coefficient of said second inner ring-like member is larger than a linear expansion coefficient of said second outer ring-like member, wherein a gap X that is the difference between the inside diameter of each outer ring-like member and the outside diameter of the corresponding inner ring-like member is expressed:

$$X=D_1(1+\alpha_1\Delta T)-D_2(1+\alpha_2\Delta T)$$

where a change in temperature from a normal temperature of 25° C. is ΔT, the inside diameter of each outside ring-like member at normal temperature is $D_1$, the linear expansion coefficient of each outer ring-like member is $\alpha_1$, the outside diameter of each inner ring-like member at normal temperature is $D_2$, and the linear expansion coefficient of each inner ring-like member is $\alpha_2$, and wherein as temperature increases, the gap X between each outer ring-like member and each inner ring-like member becomes smaller and force pinching said endless belt increases.

2. The image heating apparatus according to claim 1, further comprising a first electric contact configured to slidably contact to said first outer ring-like member for the electric energization and a second electric contact configured to slidably contact to said second outer ring-like member for the electric energization.

3. The image heating apparatus according to claim 1, wherein said first outer ring-like member, and said first inner ring-like member, said second outer ring-like member and said second inner ring-like member are made of metal.

4. The image heating apparatus according to claim 3, wherein said first outer ring-like member and said second outer ring-like member are made of copper, said first inner ring-like member and said second inner ring-like member are made of aluminum.

* * * * *